US005564539A

United States Patent [19]

Duensing

[11] Patent Number: 5,564,539

[45] Date of Patent: Oct. 15, 1996

[54] CONVERTIBLE TOTE BAG

[76] Inventor: Thirza A. Duensing, 2314 Robin La., Elgin, Ill. 60123

[21] Appl. No.: 319,582

[22] Filed: Oct. 7, 1994

[51] Int. Cl.[6] ..... A45C 7/00; A45C 13/10; A45C 13/36

[52] U.S. Cl. ..... 190/107; 190/103; 383/2; 383/4; 206/315.1; 206/278

[58] Field of Search ..... 190/1, 103–105, 190/107; 224/151, 153; 383/2, 4; 206/278, 315.1; D3/261, 271, 299, 902

[56] References Cited

U.S. PATENT DOCUMENTS

| | | | |
|---|---|---|---|
| D. 202,403 | 9/1965 | Craig | D3/271 X |
| D. 231,867 | 6/1974 | Ohyama | D3/71 |
| D. 282,602 | 2/1986 | Allen | D3/71 |
| D. 283,465 | 4/1986 | Allen | D3/71 |
| D. 287,548 | 1/1987 | Kraynack-Simon | D3/271 X |
| D. 361,889 | 9/1995 | Rhines | D3/261 |
| 3,675,843 | 7/1972 | Polansky | 229/54 R |
| 3,830,348 | 8/1974 | Ohyama | 190/107 |
| 4,011,898 | 3/1977 | Hubbard | 383/4 X |
| 4,126,256 | 11/1978 | McGruder | 383/38 X |
| 5,044,699 | 9/1991 | Dury | 383/37 |
| 5,119,519 | 6/1992 | Foreman | 5/640 |
| 5,187,823 | 2/1993 | Ferguson et al. | 383/4 X |
| 5,289,906 | 3/1994 | Guidi | 190/107 |
| 5,324,115 | 6/1994 | Weinreb | 383/2 |
| 5,390,786 | 2/1995 | Challoner et al. | 206/278 |
| 5,399,020 | 3/1995 | Cheng | 383/4 |
| 5,425,449 | 6/1995 | Boorady | 190/107 X |

FOREIGN PATENT DOCUMENTS

| | | | |
|---|---|---|---|
| 582496 | 12/1976 | Switzerland | 383/2 |

*Primary Examiner*—Sue A. Weaver
*Attorney, Agent, or Firm*—Gary R. Jarosik

[57] ABSTRACT

A convertible tote bag includes a first collapsible side, a second collapsible side, and a collapsible sheath connecting the first and second collapsible sides. At least one closable opening is provided in at least one of the collapsible sides and sheath. A foldable base connects the first and second collapsible sides and the collapsible sheath. The foldable base comprises a first portion foldably connected to a second portion and a fastener for securing the first and second portions in folded relation whereby the first and second collapsible sides and the collapsible sheath may be secured therebetween. The foldable base further includes a closable pouch and strapping whose positioning, length, and configuration is defined by the type of bag desired to be converted to.

5 Claims, 5 Drawing Sheets

CONVERTIBLE TOTE BAG

BACKGROUND OF THE INVENTION

This invention relates generally to a tote bag convertible between two varying configurations and method for performing the same and, more particularly, relates to a collapsible, multi-function, inline skate tote bag.

In the past tote bags have been used for a variety of purposes, and particularly, by individuals desiring to transport items from one place to another. With this purpose in mind, some tote bags have been especially adapted for transporting particular items. An example of one such specialized tote bag is the inline skate tote bag specifically adapted and configured to transport inline skates. However, it has been seen that a problem exists with current inline skate tote bags in that the tote bag can serve no further purpose once the skating destination has been reached owing to its singularity of purpose. This lack of duality in function leaves the skater with no alternative but to place the bag in storage at a cost or to leave the bag behind at the risk of getting stolen. Therefore, it is seen that a need exists to provide an inline skate tote bag capable of serving a dual purpose whereby the bag may be further utilized by the skater after the desired skating destination has been reached.

As a result of this existing need, it is an object of the present invention to provide an inline skate tote bag convertible into a wearable bag such as a belt bag, waist pouch, sling bag, backpack, purse, hip cushion, or the like for providing the inline skater with flexibility in use and for removing the need to leave the tote bag behind during skating.

SUMMARY OF THE INVENTION

In accordance with the present invention, a convertible tote bag is provided including a first collapsible side, a second collapsible side, and a collapsible sheath connecting the first and second collapsible sides. A foldable base connects the first and second collapsible sides and the collapsible sheath. The foldable base comprises a first portion foldably connected to a second portion and a fastener for securing the first and second portions in folded relation whereby the first and second collapsible sides and the collapsible sheath may be secured therebetween. The foldable base further includes a closable opening.

A better understanding of the objects, advantages, features, properties and relationships of the invention will be obtained from the following detailed description and accompanying drawings which set forth illustrative embodiments and is indicative of the various ways in which the principles of the invention may be employed.

BRIEF DESCRIPTION OF THE DRAWINGS

For a better understanding of the invention, reference may be had to the preferred embodiments shown in the following drawings in which.

DETAILED DESCRIPTION

While the invention can be used in described hereinafter in the context of an inline skate tote bag as the preferred embodiment thereof.

Figure 1:
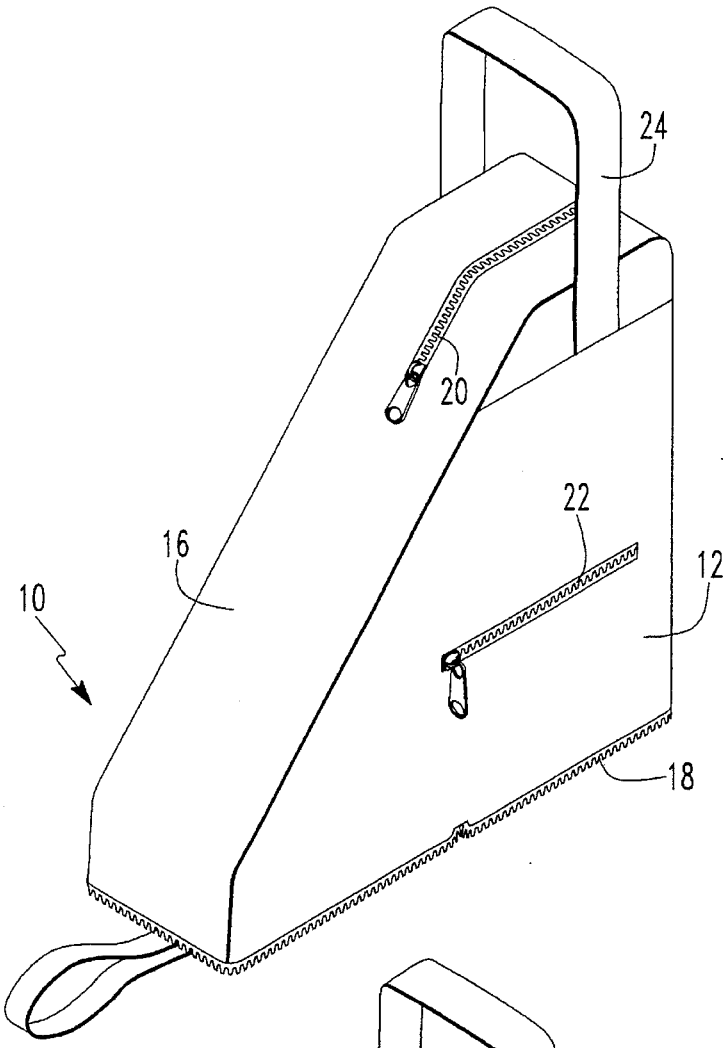
FIG. 1 illustrates a perspective view of one embodiment of the present invention.
Figure 2:
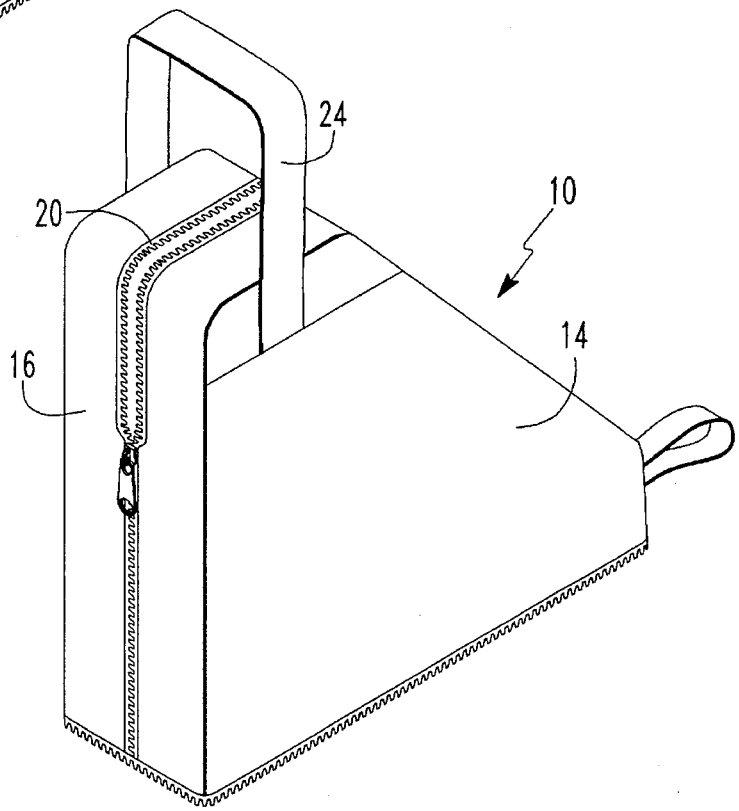
FIG. 2 illustrates a reverse perspective view of the embodiment shown in FIG. 1.

Referring now to the figures, wherein like reference numerals refer to like elements, there is shown in FIGS. 1 and 2 an inline skate tote bag 10. Inline skate tote bag 10 has two opposing, collapsible sides 12,14 generally shaped to resemble the profile of an inline skate. Connecting the upper portions of the sides 12,14 is a collapsible sheath 16 while a foldable base 18 connects the bottom portions of the sides 12,14 and the sheath 16. The general shape of the sides 12,14 is illustrative only and other side wall configurations have been contemplated for allowing differing items to be carried in the tote bag.

To ease in the collapsibility of the sides 12,14 and the sheath 16, the sides 12,14 and the sheath 16 should be constructed from nylon, cotton canvas, vinyl, leather, or other suitable material having the characteristics of durability and non-rigidity. A preferable material is water resistant. The tote bag 10 is further provided with at least one closable opening 20 which may be positioned in any of the sides 12,14, sheath 16, or foldable base 18. The closable opening 20 allows for access into the tote bag 10 and may be constructed to include a zipper, clasp, snap, buckle, VELCRO, lacing, draw string, or similar type of fastening device. The tote bag 10 may also be provided with supplemental, closable pouches 22 for providing extra storage compartments. Finally, any number of optional straps or carrying handles 24 may be provided and attached to the tote bag 10 for allowing easy transportation.

Figure 3:
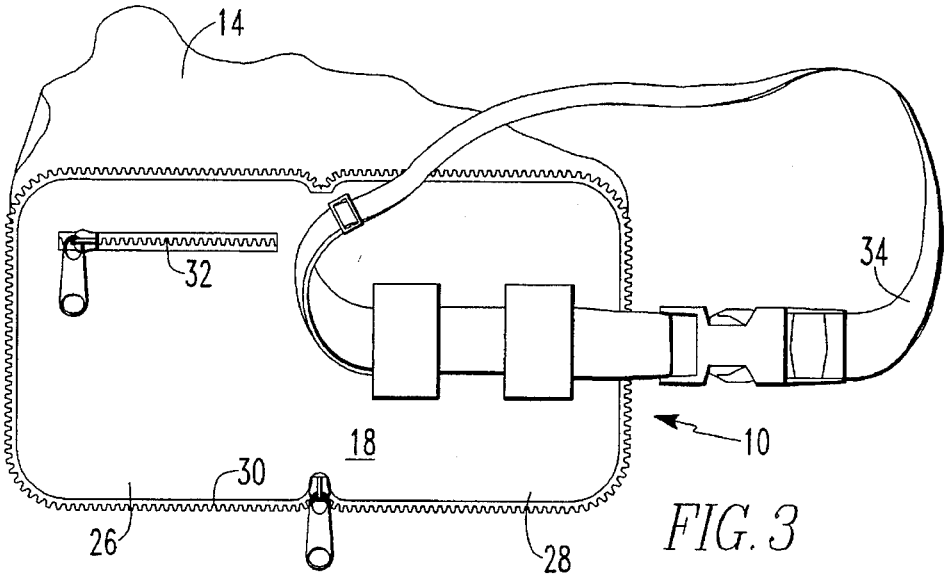
FIG. 3 illustrates a bottom view of the embodiments shown in FIGS. 1 and 2.
Figure 4:
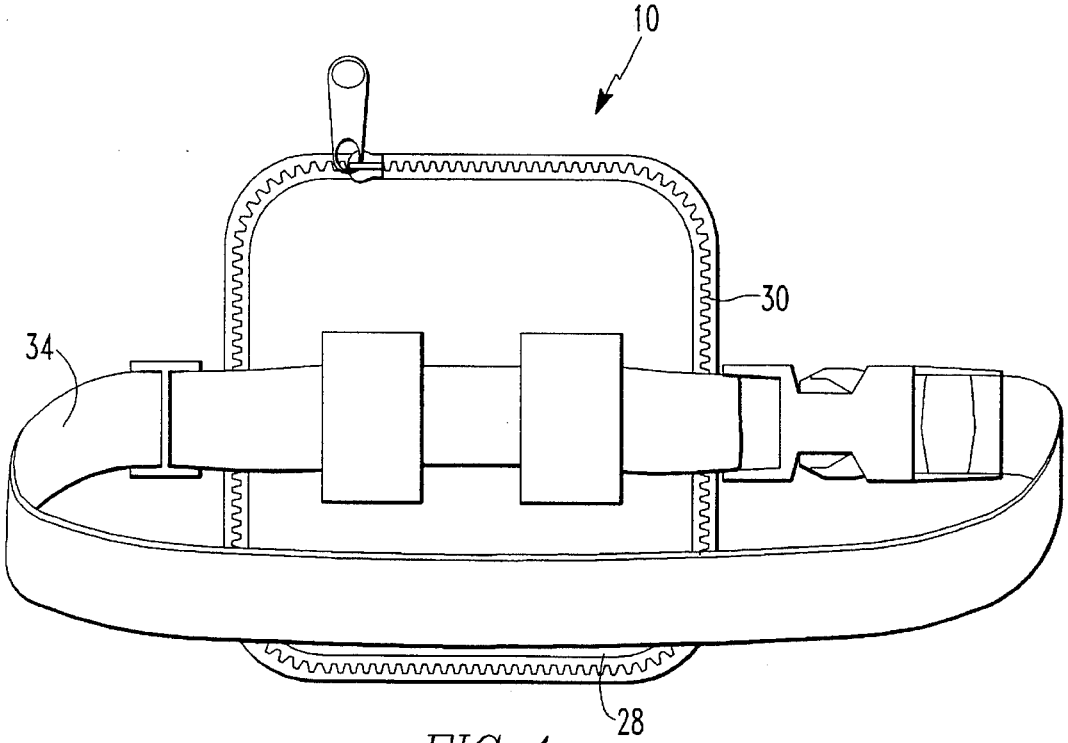
FIG. 4 illustrates the embodiment of Figs. 1–3 in the folded or converted configuration.
Figure 5:
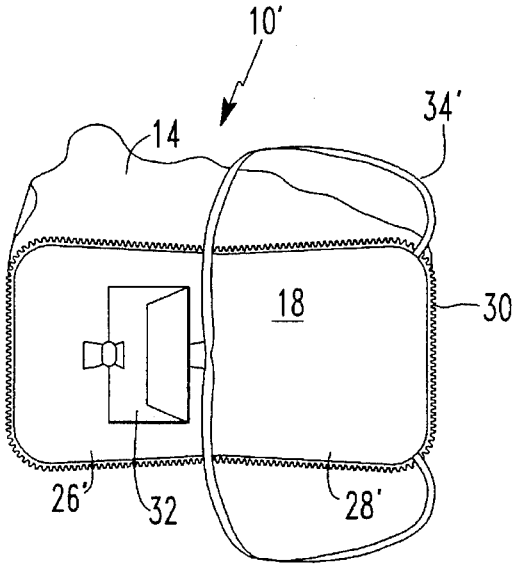
FIG. 5 illustrates a bottom view of a further embodiment of the present invention.
Figure 7:
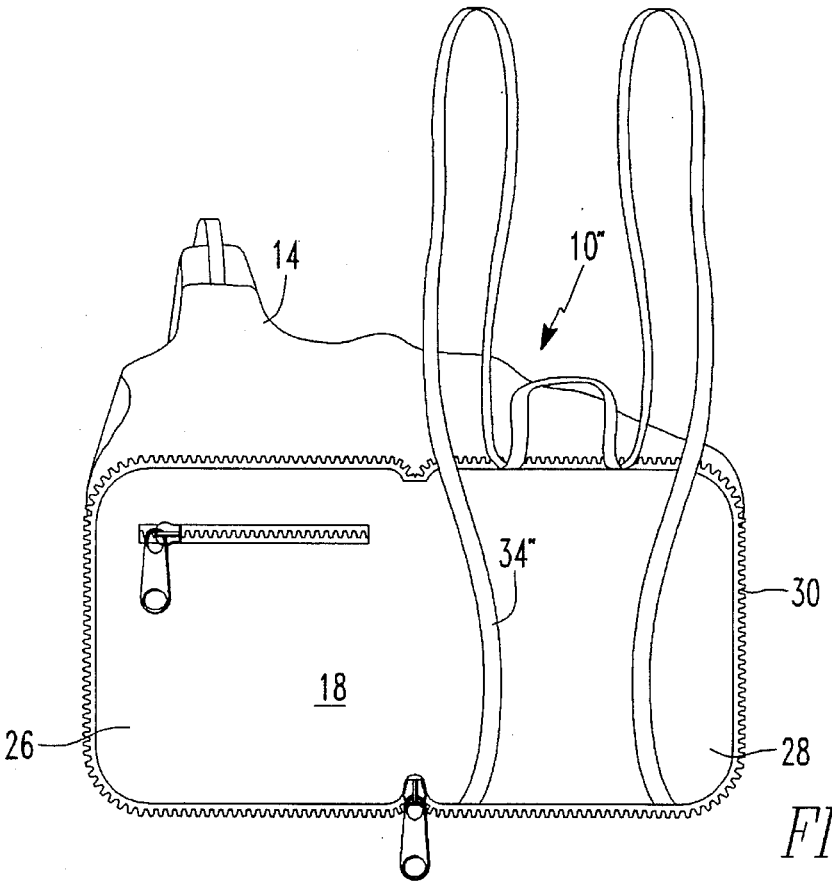
FIG. 7 illustrates a bottom view of a further embodiment of the present invention.
Figure 6:
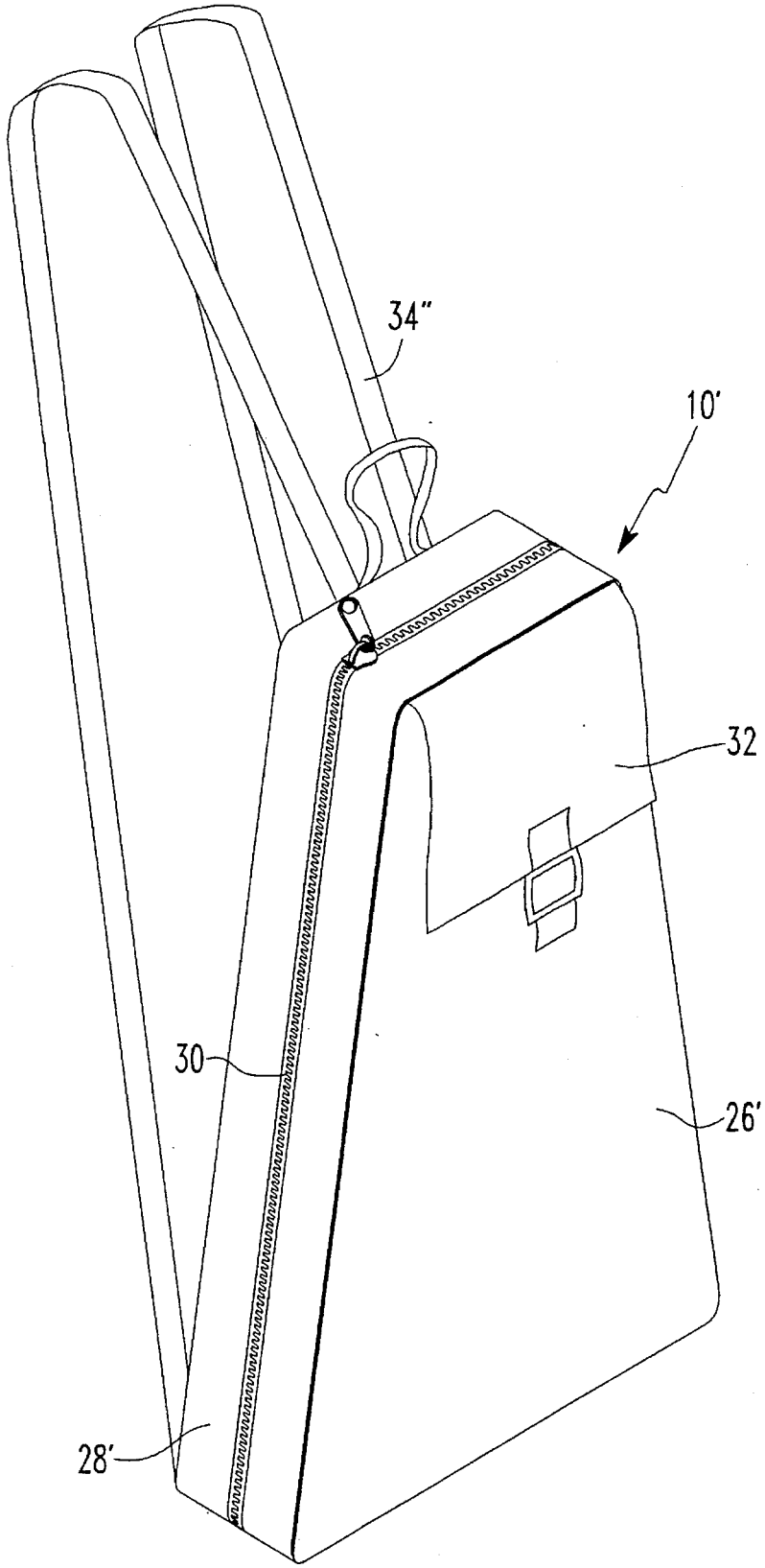
FIG. 6 illustrates a perspective view of the embodiment of FIG. 5 in the folded or converted configuration.
Figure 8:
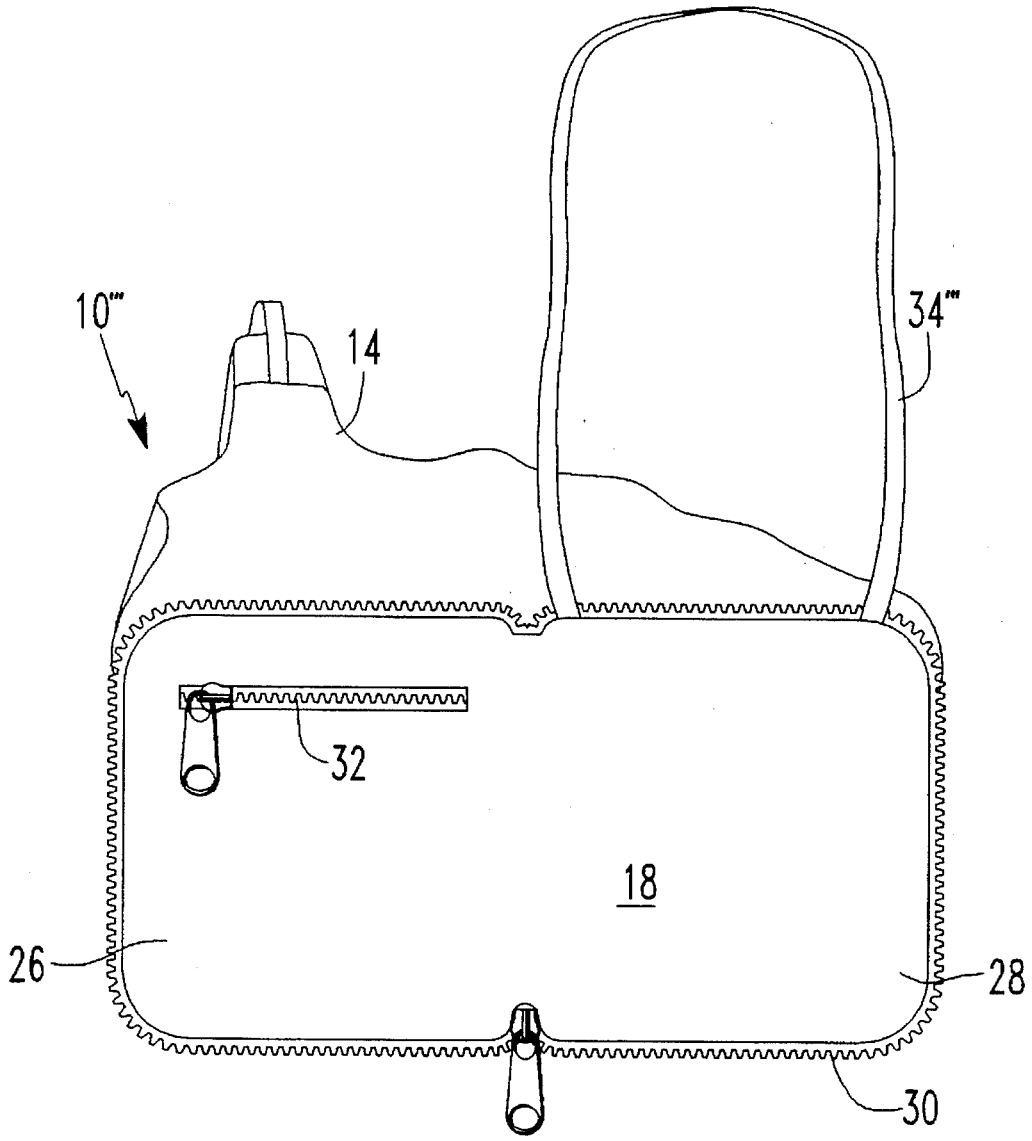
FIG. 8 illustrates a bottom view of a fourth embodiment of the present invention.

The foldable base 18 is illustrated more particularly in FIGS. 3–4 and includes a first portion 26 and a second portion 28 which are foldably connected along the approximate line bisecting the base 18. During operation, to convert the tote bag, the sides 14,16 and sheath 18 are collapsed somewhat flush against the foldable base 18 whereafter the first and second portions 26, 28 are caused to be folded together securing the collapsed material therebetween. In order to the maintain tote bag 10 in its converted configuration a fastening device 30 is used to secure the first portion 26 in folded relation with the second portion 28. In the illustrated embodiment a zipper is employed as the fastening device 30 although any type of fastening device capable of maintaining the folded relationship between the first and second portions is contemplated. Furthermore, while the illustrated embodiment utilizes first and second portions which are approximate mirror images of each other, it is contemplated that the portions may be of varying sizes for the purpose of providing extra storage pockets, carrying straps, or the like.

To allow for storage in the converted configuration, the foldable base 18, which becomes the face of the converted bag, includes a supplemental closable opening 32 leading to a pouch area. While a zipper is illustrated as the fastening device in the embodiment depicted, any type of fastening device is contemplated. Furthermore, the foldable base 18 may be supplied with a supplemental, detachable strap or handle 34 for allowing the tote bag to be transported in its altered configuration.

While FIGS. 1–4 illustrate a tote bag convertible between an inline skate tote bag and a belt bag, FIGS. 5–8 illustrate other contemplated embodiments including a backpack configuration and a sling bag configuration. Furthermore, it is contemplated that other various attachable and detachable devices may be added to facilitate the transport of additional personal items.

It should be apparent from the preceding description that this invention has among other advantages, the advantage of providing a convenient tote bag for inline skates, pads, and personal articles which is convertible into a smaller, wearable bag.

It is to be understood that the descriptions and drawings shown with respect to the present invention are not limiting and that other convertible tote bag arrangements utilizing the concepts of the present disclosure are contemplated.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

I claim:

1. A convertible tote bag, comprising:

a first collapsible side formed substantially in the shape of an athletic boot;

a second collapsible side formed substantially in the shape of an athletic boot and symmetrically disposed opposite said first collapsible side;

a collapsible sheath connecting said first and second collapsible sides;

a foldable base, connected to said first and second collapsible sides and said collapsible sheath, comprising a first portion foldably connected to a second portion, said second portion being moveable between a first position wherein said first and second portions are substantially aligned in a first plane and a second position wherein said first portion is substantially diposed in said first plane and said second portion is substantially disposed in a second plane parallely aligned with said first plane; and a fastener connected to said first and second portions for securing said second portion in said second position;

wherein said tote bag is convertible between a first bag, defined by said first collapsible side, second collapsible side, collapsible sheath, and foldable base when said second portion is in said first position, being specifically adapted for use in securing therein a pair of athletic boots in symmetrical, parallel alignment, and a second bag, defined by said first portion and said second portion when said second portion is in said second position.

2. The convertible tote bag of claim 1, wherein said first and second portions are nearly identically shaped and foldably connected along a line approximately bisecting said foldable base.

3. The convertible bag of claim 2, further comprising at least one strap connected to said foldable base.

4. The convertible tote bag of claim 2 wherein said fastener comprises a zipping mechanism disposed around the circumference of said foldable base.

5. The convertible bag of claim 4, further comprising a water resistant, nylon material.

* * * * *